United States Patent [19]

Uesaka et al.

[11] Patent Number: 4,681,229

[45] Date of Patent: Jul. 21, 1987

[54] NOTE SORTING AND COUNTING APPARATUS

[75] Inventors: Sadaaki Uesaka; Toshio Numata; Kazunori Umezaki, all of Himeji, Japan

[73] Assignee: Glory Kogyo Kabushiki Kaisha, Japan

[21] Appl. No.: 673,314

[22] Filed: Nov. 20, 1984

[30] Foreign Application Priority Data

Dec. 12, 1983 [JP] Japan ..... 58-233899
Dec. 12, 1983 [JP] Japan ..... 58-233900
Dec. 12, 1983 [JP] Japan ..... 58-233901

[51] Int. Cl.[4] ..... B07C 5/34; G06M 7/06

[52] U.S. Cl. ..... 209/534; 209/551; 271/3.1; 377/8

[58] Field of Search ..... 209/534, 551; 235/379; 271/3.1, 9; 377/8; 194/205-207; 109/24.1

[56] References Cited

U.S. PATENT DOCUMENTS 4,015,110 3/1977 Jones ..... 377/8
4,326,636 4/1982 Kawakami ..... 209/534
4,402,410 9/1983 Ohba et al. ..... 209/534
4,418,417 11/1983 Uchida et al. ..... 377/8
4,465,193 8/1984 Kokubo et al. ..... 209/534
4,514,856 4/1985 Asai et al. ..... 377/8

FOREIGN PATENT DOCUMENTS 2093809 9/1982 United Kingdom ..... 209/534
2106080 4/1983 United Kingdom ..... 209/534
2127792 4/1984 United Kingdom ..... 209/534

*Primary Examiner*—Robert B. Reeves
*Assistant Examiner*—Edward M. Wacyra
*Attorney, Agent, or Firm*—Beveridge, Degrandi & Weilacher

[57] ABSTRACT

A note sorting and counting apparatus comprises an ejecting device for ejecting notes one by one from a stack of notes, an identifying device for identifying the notes, a sorting device for sorting the notes into groups in accordance with the result of the identification, and a plurality of containers allotted to the respective groups, each container receiving the notes of the group to which it is allotted. The identification may be as to whether the note is obverse or reverse, and as to the denomination, and the notes may be sorted into groups comprising obverse notes of the respective denominations and a group comprising reverse notes. The identification may alternatively include one as to whether the note is normal or damaged, and the notes may then be sorted into a group comprising obverse and normal notes and a group comprising obverse and damaged notes. The apparatus may additionally be provided with a denomination designating device, in which case the sorting may be into a group comprising obverse and normal notes of the designated denomination, a group comprising obverse and damaged notes of the designated denomination, and a group comprising notes of the denominations which are not designated.

12 Claims, 15 Drawing Figures

FIG. 8(b)

| | DENOMINATION | NUMBER (MMM) | | AMOUNT (KMM) | |
|---|---|---|---|---|---|
| | | NORMAL | DAMAGED | NORMAL | DAMAGED |
| MAIN MEMORY SECTION MM | $ 1 | | | | |
| | $ 2 | | | | |
| | $ 5 | | | | |
| | $ 10 | | | | |
| | $ 20 | | | | |
| | $ 50 | | | | |
| | $ 100 | | | | |
| | TOTAL | | | | |

| | |
|---|---|
| BATCH NUMBER MEMORY BCM | |

| | | | |
|---|---|---|---|
| MODE FLAGS MFG | CONTINUOUS DENOMINATION SORTING | | DENOMINATION SORTING MODE |
| | BATCH DENOMINATION SORTING | | |
| | CONTINUOUS NORMAL / DAMAGED | | NORMAL / DAMAGED SORTING MODE |
| | BATCH NORMAL / DAMAGED | | |

FIG. 8

| | |
|---|---|
| FIG. 8(a) | FIG. 8(b) |

FIG. 8(a)

| BUFFER MEMORY SECTION BM | DENOMINATION | NUMBER (MBM) | | AMOUNT (KBM) | |
|---|---|---|---|---|---|
| | | NORMAL | DAMAGED | NORMAL | DAMAGED |
| | $ 1 | | | | |
| | $ 2 | | | | |
| | $ 5 | | | | |
| | $ 10 | | | | |
| | $ 20 | | | | |
| | $ 50 | | | | |
| | $ 100 | | | | |
| | TOTAL | | | | |
| | REJECTED, REVERSE | | | | |

| DENOMINATION FLAGS DFG | | |
|---|---|---|
| | $ 1 | |
| | $ 2 | |
| | $ 5 | |
| | $ 10 | |
| | $ 20 | |
| | $ 50 | |
| | $ 100 | |

| COINCIDENCE FLAGS IHF | | NORMAL | DAMAGED |
|---|---|---|---|
| | $ 1 | | |
| | $ 2 | | |
| | $ 5 | | |
| | $ 10 | | |
| | $ 20 | | |
| | $ 50 | | |
| | $ 100 | | |
| | | | |

FIG. 12

| | MODE / CONTAINER | 1st | 2nd | 3rd | 4th | 5th | 6th | 7th |
|---|---|---|---|---|---|---|---|---|
| A | DENOMINATION SORTING | RJ· REV ·$2 | $ 100 (OBV) | $ 50 (OBV) | $ 1 (OBV) | $ 5 (OBV) | $ 10 (OBV) | $ 20 (OBV) |
| B | NORMAL/DAMAGED SORTING | RJ· REV ·$2 | | | NORMAL (OBV) | NORMAL (OBV) | DAMAGED (OBV) | DAMAGED (OBV) |
| C | DESIGNATED DENOMINATION & NORMAL/DAMAGED SORTING | RJ· REV ·$2 | | DIFFERENT DENOMI-NATIONS | NORMAL (OBV) | NORMAL (OBV) | DAMAGED (OBV) | DAMAGED (OBV) |

NOTE SORTING AND COUNTING APPARATUS

BACKGROUND OF THE INVENTION

The present invention relates to a note sorting and counting apparatus which can draw out one by one, notes (or bills) accumulated in a stack, and sort the notes, according to the denomination of note, or depending on whether the note is obverse-showing or reverse-showing, or whether the note is normal or damaged.

It is known in the art that a conventional apparatus of this kind has a plurality of sorting functions, such as a function to sort notes according to the denomination, a function to sort notes depending on whether the note is normal (a piece of paper currency which is normal or undamaged) or damaged (a piece of paper currency which is damaged), a function to sort notes depending on whether the note is obverse-showing or reverse-showing (sorting notes into notes showing the obverse or front side and notes showing the reverse or back side), and that the apparatus can be used by selecting any one or more of the above functions.

With such an apparatus, when only the obverse-showing notes of a specific denomination are to be collected, sorting according to the denominations and sorting according to the side shown of the note are performed one after another.

Further, when only the normal (undamaged) notes with the front in view, or the damaged notes with the back in view are to be collected, or when only the normal (undamaged) notes of the designated denomination and with the front showing or the damaged notes of the designated denomination and with the back showing are to be collected, operations having different sorting functions respectively had to be performed one after another.

Therefore, the work requires much labor of an operator is cumbersome and is time-consuming. Moreover, since sorting operations are performed a number of times, a probability for an accident to occur before the work is completed increases, the accident being such as note clogging, note transport miss or the like, and it takes a long time to obtain a collection or an accumulation of desired kind of notes.

SUMMARY OF THE INVENTION

It is an object of the present invention to provide a note sorting and counting apparatus which can obtain efficiently and quickly an accumulation of desired notes even where notes are to be sorted depending on the denomination of note and also depending on whether the note is obverse-showing or reverse-showing.

It is another object of the present invention to provide a note sorting and counting apparatus which can obtain efficiently and quickly an accumulation of desired notes even where notes are to be sorted depending on whether the note is normal or damaged and also depending on whether the note is obverse-showing or reverse-showing.

It is a further object of the present invention to provide a note sorting and counting apparatus which can obtain efficiently and quickly an accumulation of desired kind of notes even where notes are to be sorted depending on whether the note is a normal (undamaged) note of the designated denomination or a damaged note of the designated denomination, or also depending on whether the note is an obverse-showing note of the designated denomination or a reverse-showing note of the designated denomination.

According to one aspect of the invention, there is provided a note sorting and counting apparatus comprising:

ejecting means for ejecting notes one by one from a stack of notes;

identifying means for identifying the notes ejected by said ejecting means, the identification being at least as to whether said note is obverse or a reverse and as to the denomination;

sorting means for sorting the notes successively ejected by said ejecting means, into groups comprising obverse notes of the respective denominations and a group comprising reverse notes, in accordance with the result of the identification made by said identifying means; and a plurality of containers allotted to the respective groups, each container receiving said notes of the group to which it is allotted.

According to a second aspect of the invention, there is provided a note sorting and counting apparatus comprising:

ejecting means for ejecting notes one by one from a stack of notes;

identifying means for identifying the notes ejected by said ejecting means, the identification being at least as to whether said note is obverse or reverse and as to whether said note is normal or damaged;

sorting means for sorting the notes successively ejected by said ejecting means, into a group comprising obverse and normal notes and a group comprising obverse and damaged notes, in accordance with the result of the identification made by said identifying means; and a plurality of containers allotted to the respective groups, each container receiving said notes of the group to which it is allotted.

According to a third aspect of the invention there is provided a note sorting and counting apparatus comprising:

ejecting means for ejecting notes one by one from a stack of notes;

identifying means for identifying the note ejected by said ejecting means, the identification being at least as to whether said note is obverse or reverse, as to whether said note is normal or damaged, and as to the denomination of the note;

denomination designating means for designating the denomination;

sorting means for sorting the notes successively ejected by said ejecting means, into a group comprising obverse and normal notes of the designated denomination, a group comprising obverse and damaged notes of the designated denomination and a group comprising notes of the denomination or-denominations which are not designated, in accordance with the result of the identification made by said identifying means; and a plurality of containers allotted to the respective groups, each container receiving said notes of the group to which it is allotted.

BRIEF DESCRIPTION OF THE DRAWINGS

FIG. 8 is diagram of the arrangement of FIGS. 8(a) and 8(b);

FIGS. 8(*a*) and 8(*b*) are diagrams showing memory areas of a data memory;

FIG. 12 is a table showing an allotment of containers in each of the operation modes.

DESCRIPTION OF THE PREFERRED EMBODIMENTS

Figure 1:
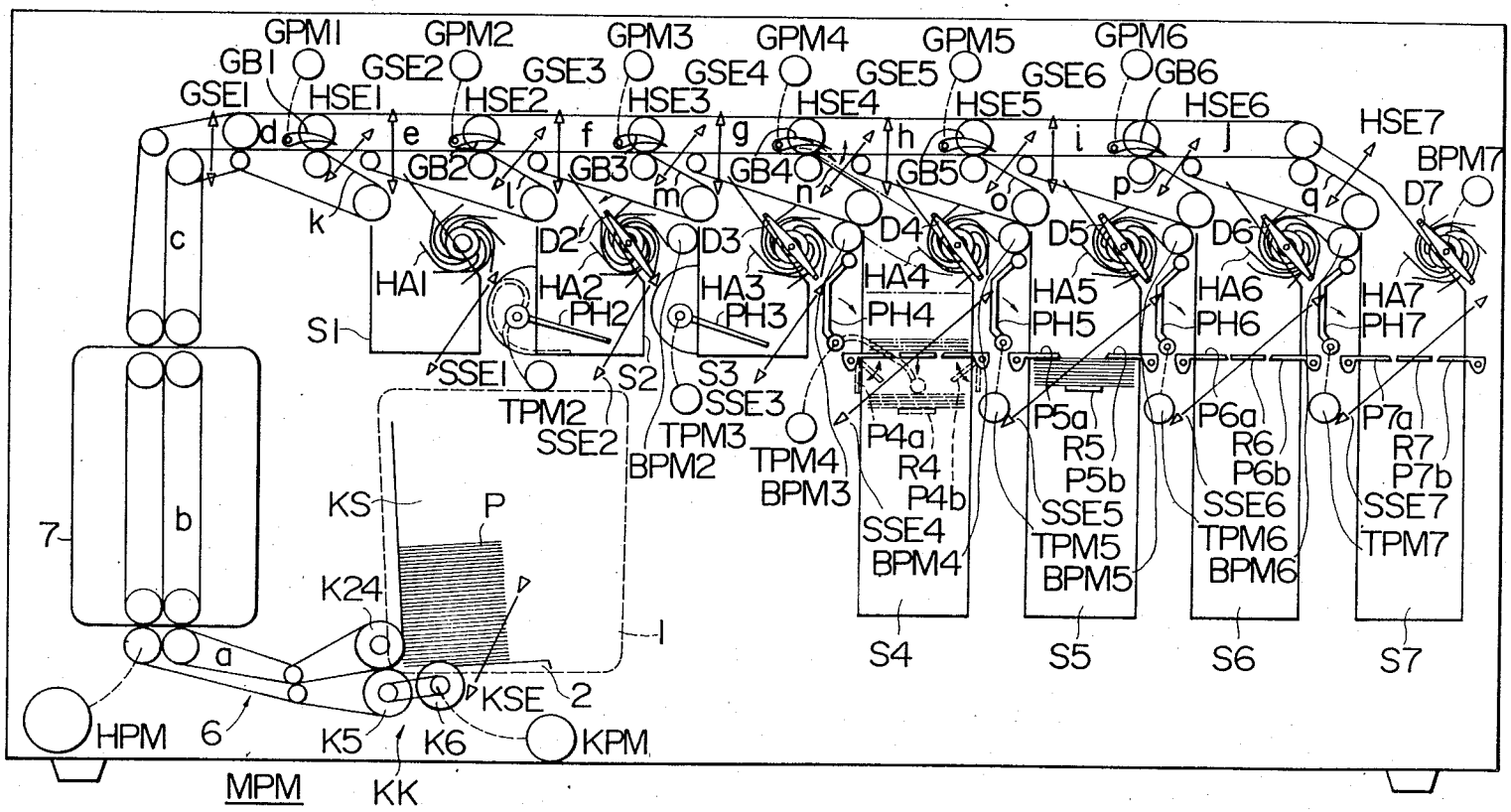
FIG. 1 is a schematic view illustrating the general construction of an embodiment of a note sorting and counting apparatus according to the present invention.

FIG. 1 shows the general arrangement of a note sorting and counting apparatus according to an embodiment of the present invention.

On the front side of a main body of the counting apparatus, there is provided a note reception inlet 1. Inside of the note reception inlet 1, there is a note receiving section KS which is provided with a note receptacle 2 such that an operator holding a stack of notes can insert it from the front side of FIG. 1 through the note reception inlet 1 and place it on the note receptacle 2. A note ejecting mechanism KK, for ejecting notes one by one from the bottom of the notes stacked or piled on the note receptacle 2, is mounted below the note receiving section KS. The receiving section KS and the note ejecting mechanism KK will be described in detail later with reference to FIGS. 3 to 5.

Notes ejected or sent out one by one by the note ejecting mechanism KK are transported or conveyed by a transporting belt 6, and are identified in turn by an identifying section 7. The identification may be as to whether it is a true or counterfeit note, an obverse-showing or reverse-showing note (hereinafter referred simply to "obverse note" or "reverse note") and a normal (undamaged) or damaged note, and as to the denomination of the note. The identification is also made to detect any link (no spacing between successive notes), abnormal thickness (due for example of superposition of two or more notes), oblique motion, tear, and the like. The identification technique itself is known in the art, and since it is not the gist of the present invention, the description thereof is omitted.

Transport belts 6 forming a transport section MPM are driven by a drive motor HPM and constitute a transport system a through q. Impellers HA1 to HA7, described later, are also driven and rotated in synchronism with the transport belts 6.

The notes are sorted and introduced into first through seventh containers S1 to S7, in accordance with the result of the identification made at the identification section 7. The kinds of the notes introduced into the respective containers are different as shown in FIG. 12 depending on the particular mode the apparatus is operating in.

While travelling along the transport system d to j, the notes are deflected to and sent into the respective containers by gate plates GB1 to GB6, in accordance with the result of the identification.

The notes conveyed by any of the respective transporting systems k to q are introduced between the respective adjacent vanes (with one note inserted between each pair of adjacent vanes) of the impeller, which is revolving counter-clockwise as seen in the figure and causes the notes to be stacked in the retaining space below the impeller.

The second and third containers S2 and S3 are respectively provided with separators PH2 and PH3 which separate the retaining sections above the separators from storage sections below the separators. When notes sent into each container are to be divided into lots, the notes already accumulated and forming a lot are separated from the subsequent notes forming another or next lot by the separator PH2 or PH3. This is done by inserting the separator PH2 or PH3 before the first-coming note of the "next" lot is sent via the impeller HA2 or HA3. The separators PH2 and PH3 are in the form of a plate or rod made of rubber, and are driven and rotated clockwise in the figure by drive motors TPM2 and TPM3 described later, so as to be placed on the notes already piled up.

Figure 2:
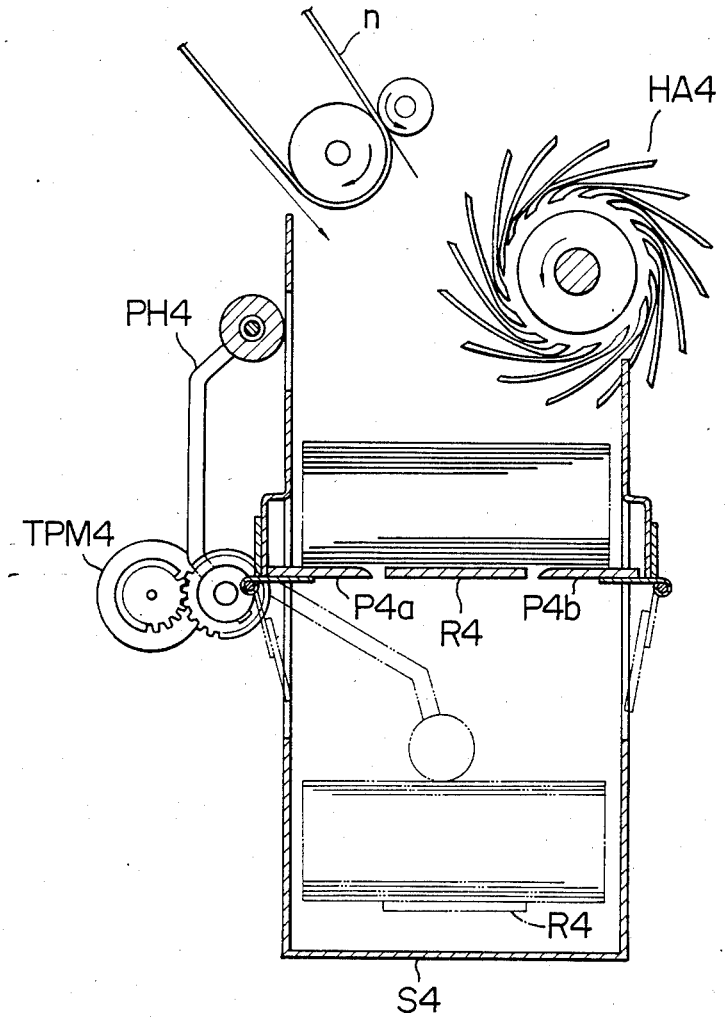
FIG. 2 is a detailed view of a note container.

The fourth to seventh containers S4 to S7 are respectively provided with pushers PH4 to PH7 shown in FIG. 1. As will be understood from FIG. 2 which shows in an enlarged scale the fourth container only (the fourth to the seventh containers are alike), the pushers PH4 to PH7 push down the notes piled on pairs of supporting plates P4a to P7a and P4b to P7b, respectively, provided in the respective containers. The pairs of supporting plates P4a to P7a and P4b to P7b are biased by springs, not shown, so as to maintain a horizontal position (as shown by a solid line). When the pushers PH4 to PH7 are moved downward (clockwise), then the supporting plates P4a to P7a and P4b to P7b are pivoted against the spring forces, to assume inclined and then vertical positions, as shown by a chain line for the plates P4a and P4b in FIG. 1. In other words, they are retracted to be outside of the wall of the container.

The notes pushed down into the lower portion or storage section of the container by the pushers PH4–PH7, are received and supported by the bearing plate R4–R7. The bearing plates R4–R7 are biased upward by a spring, not shown, or the like, and the bearing plate is lowered further as the amount and hence the thickness of the stack of notes on it are increased. The pushers PH4–PH7 thus constitute transfer mechanisms for transferring notes from the retaining section to the storage section in each container S4–S7.

Divider D2 to D7 are mounted on the impellers HA2 to HA7 respectively. Each divider is disposed coaxial with the axis of rotation of the impeller and rotates independently of the impeller. The divider is used during a batch processing where a predetermined number of notes are separated from other notes. The divider is at rest at the position shown in FIG. 1 and starts rotating counter clockwise when the note of the predetermined count number have been sent in, to a position where it blocks passage of the notes and retains the notes on it. That is, after the predetermined number of notes are accumulated on the supporting plate P4a–P7a and P4b–P7b, the notes subsequently sent in are supported by the divider D2–D7 and prevented from falling down on to the supporting plate P4a–P7a and P4b–P7b. It is to be noted that while the dividing processing is being performed, the ejecting, transporting, and sorting operations are continued, that is these operations are not interrupted, provided that an operator removes the piled-up notes on the supporting plate before the notes retained on the dividers D2–D7 reach a predetermined number (such as 50). If the piled-up notes on the supporting plate are not removed in time, the ejecting operation is automatically stopped. This is because the number of notes the divider can hold has a limitation (such as 50) and if more notes are placed on the divider, then the impeller cannot operate properly due to the collision of the retained notes with the vanes of the impeller. In order to prevent such collision, the ejecting operation is interrupted.

Next, various optical sensors will be described.

A receptacle note sensor KSE is for detecting the presence of a note on the note receptacle 2. The sensor KSE, includes a light source positioned inside of the note reception inlet 1 to emit light rays toward the note receptacle 2 and a light receptor mounted below the note receptacle 2 to receive the emitted light rays.

Sensors GSE1 to GSE6 of pre-gate detecting sections are provided to sense the leading edge of each note whereupon the respective gate plates GB2 to GB6 are actuated if the particular note is of the kind to be sent into the associated container.

Sensors HSE1 to HSE7 of post-gate detecting section are provided to detect the passage of the trailing edge of the note whereupon the gate plate GB2–GB6 is returned to the rest or original position.

Sensors SSE1 to SSE7 of container note detecting section are provided for detecting any note held in the first to seventh containers S1 to S7, respectively. The sensors for the fourth to seventh containers S4 to S7 detect the notes supported by the supporting plates P4a to P7a and P4b to P7b, respectively.

Next, various drive sections will be described.

A note ejecting drive section KPM comprises a pulse motor which actuates an ejecting roller K6 to cause intermittent rotation to thereby eject notes one by one. During the rotation of the roller K6, gate rollers K5 and K24 are also made to rotate.

A transport drive section HPM drives and rotates belts (indicated generally by a reference numeral 6) in the transport system a to q with a transport drive motor (indicated also by HPM in FIG. 1). The impellers HA1 to HA7 are also driven to rotate in synchronism therewith. The impellers may alternatively be driven by a separate motor.

A gate drive section comprises rotary solenoids or pulse motors GPM1 to GPM6, which drive or actuate the gate plates GB1 to GB6 to effect change-over of the respective gate plates GB1 to GB6.

A divider drive section comprises pulse motors BPM2 to BPM7, which drive the dividers during batch processing.

A container drive section comprises pulse motors TPM2 TPM7, which rotate the separators PH2 and PH3 to effect separation of each lot, or rotate the pushers PH4 to PH7 by a preset angle to transfer and place the piled-up notes onto the bearing plates R4 to R7 and thereafter rotate in a reverse direction to return the plates R4 to R7 to the rest or waiting position.

Figure 3:
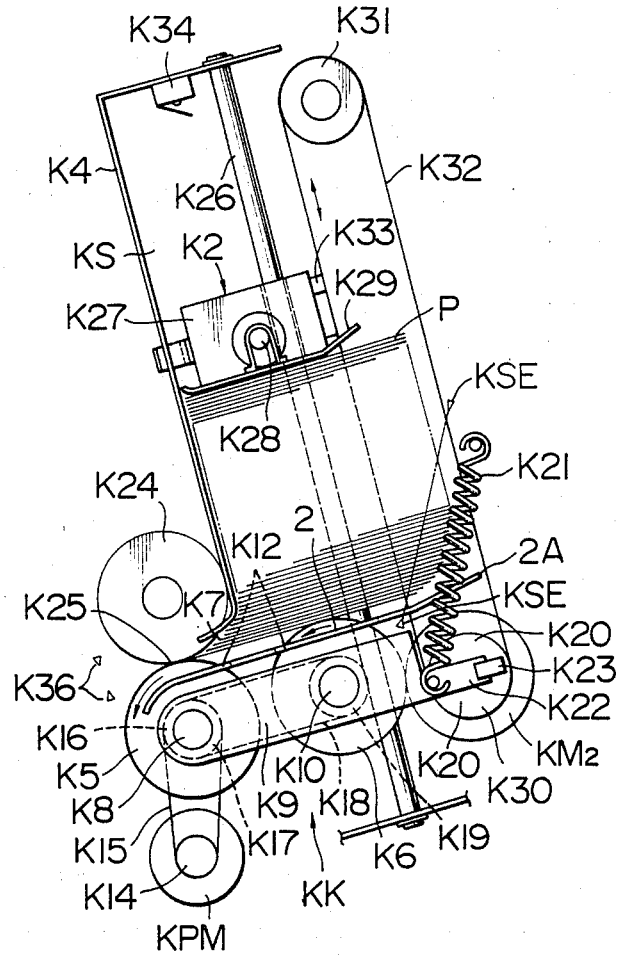
FIG. 3 is a side elevational view of an example of note receiving section and note ejecting mechanism ejecting notes one by one.
Figure 4:
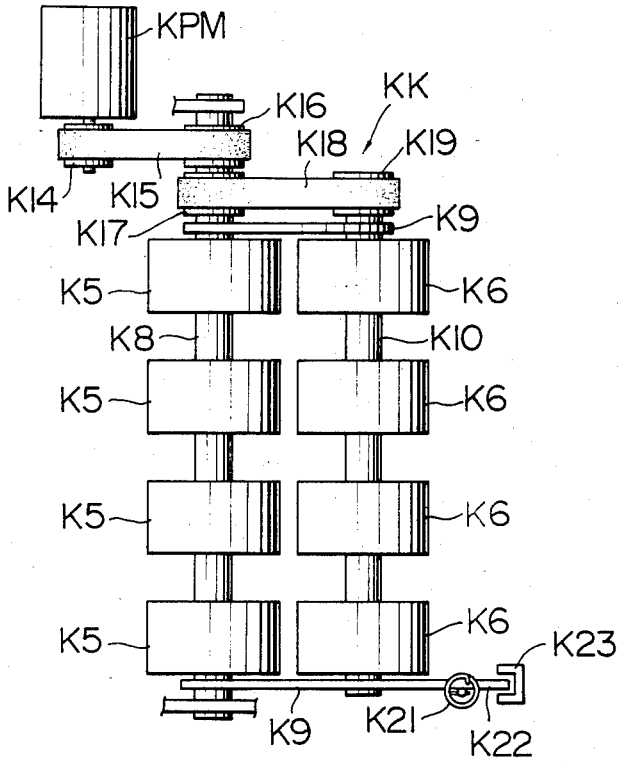
FIG. 4 is a plan view of an ejecting member of the ejecting mechanism shown in FIG. 3.
Figure 5:
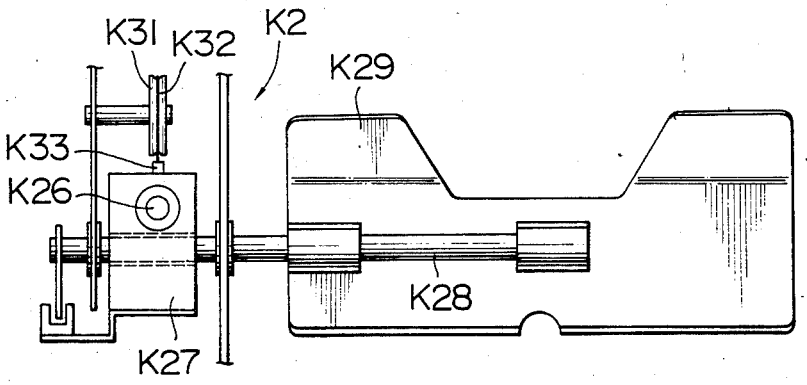
FIG. 5 is a plan view of a pusher shown in FIG. 3.
Figure 6:
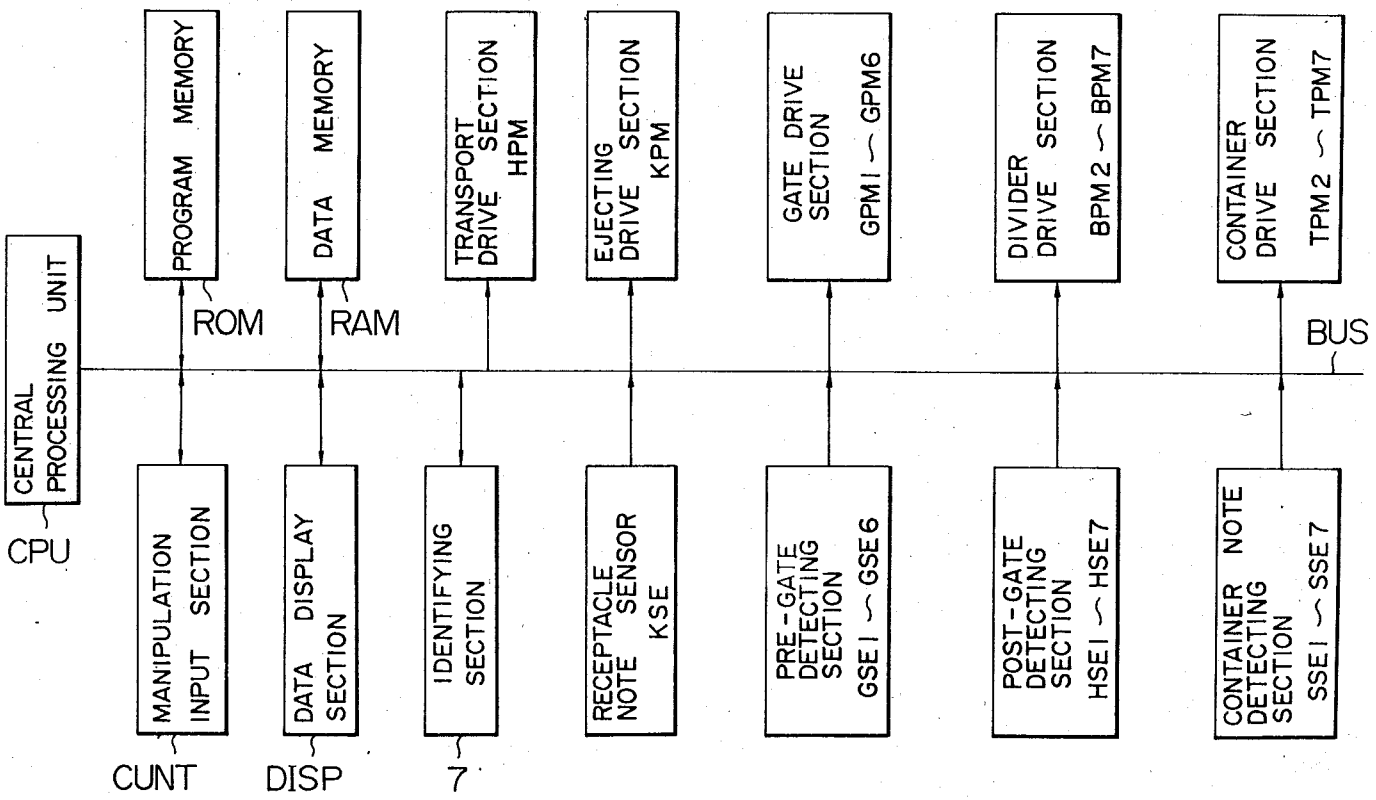
FIG. 6 is a block diagram showing a control system.

FIGS. 3 to 5 show details of the note receiving section KS and the note ejecting mechanism KK. In the note receiving section KS and the note ejecting mechanism KK illustrated in FIGS. 3 to 5, notes P are vertically stacked or piled and are ejected or sent out one by one from the bottom of the stack of notes. FIG. 3 is an elevational sectional view as seen from a side, FIG. 4 is a plan view of the note ejecting mechanism KK, and FIG. 6 is a plan view of a pusher K2, respectively.

The note receiving section KS is used for loading notes P, which are loaded or charged in a stack in the interior of a front plate K4 slanted forward. Provided under the note receiving section KS is a note ejecting mechanism KK for ejecting the notes one by one.

The note ejecting mechanism KK comprises, in the example shown in the figures, a front ejecting roller K5 and a rear ejecting roller K6. As shown in FIG. 4 each of these rollers comprises a plurality of (in the illustrated example, four) elementary rollers aligned and disposed side by side in a direction perpendicular to the direction along which the notes are moved for ejection.

The front ejecting roller K5 is positioned near an ejecting aperture K7 formed under the front plate K4, and is mounted on a shaft K8. The rear ejecting roller K6 is mounted on a shaft K10 between a pair of swing arms K9 and K9, pivotally supported at one end thereof by the shaft K8.

The upper parts of the respective rollers K5 and K6 protrude upward through openings K12 and K12 formed in the note receptacle plate 2 of the note receiving section KS. The rear end portion 2A of the note receptacle plate 2 is bent slant upward to support the rear bottom portion of the notes P.

A rotation in a direction indicated by an arrow is transmitted to the shaft K8 from an ejecting motor KPM through a pulley K14, a belt K15, and a pulley K16. A rotation is further transmitted from the shaft K8 to the shaft K10 through a pulley K17, a belt K18, and a pulley K19. The ejecting rollers K5 and K6 are therefore rotated in the same direction and at the same speed.

The free end of one of the swing arms K9 is abuttable against a stopper K20 fixedly connected to the frame to define the lower limit of the motion of the arms K9. And a tension spring K21 is mounted to extend between the swing arm K9 and the frame such that, in a normal state, the rear ejecting rollers K6 are biased in a direction of raising the rollers K6. A reference number K20A designates a stopper for defining an upper limit of the motion of the swing arms K9.

The free end of that swing arm K9 which is abuttable with the stoppers is provided with a narrow detection portion K22 projected therefrom, and a sensor K23 is mounted and fixed relative to the frame, so as to be in alignment with the detection portion K22 when the swing arm K9 abuts against the stopper K20.

The gate roller K24 is positioned above the front ejecting roller K5, and a gate portion K25 is formed of the adjacent circumferential surfaces of the front ejecting roller K5 and the gate roller K24, by which only a single note is passed and passage of the next-coming and following notes is prevented.

A pusher K2 is mounted such that it can move up and down along a guide rod K26 mounted on the frame and extending in a direction of piling of the note. As shown in FIG. 5, a pusher plate K29 is mounted on an arm shaft K28 having one end supported by a block K27. The block is slidable along the guide rod K26. The pusher plate K29 is placed upon the stack of notes P.

Pulleys K30 and K31 are rotatably supported adjacent the upper and lower portions of the guide rod K26, and a wire rope K32 is wound around the pulleys K30 and K31. The block K27 is fixed to the wire rope K32 by means of a coupling portion K33. Connected to the shaft of the lower pulley K30 is a pusher xotor KM2 which rotates to move up and down the pusher plate K29 via the block K27. The pusher motor KM2 is actuated responsive to a signal delivered from the sensor K22, which signal is produced when the detection portion K22 of the swing arm K9 is not in alignment with the sensor K22, and is stopped when the detection portion K22 comes in alignment with the sensor K23.

K34 designates a switch for detecting the upper limit of the pusher K2 when it is in the upper limit position, KSE represents sensors for detecting the presence of a note P in the note receiving section KS, and K36 represents sensors for counting notes which are ejected.

The operation of the note receiving section and the note ejecting mechanism will now be described.

When notes P are not placed in the note receiving section KS, the pusher K2 is located at the uppermost position. When notes P are placed on the note receptacle plate, the rear ejecting roller K6 are pushed downward by the weight of the notes P. Therefore, the swing arm K9 rotates clockwise as seen in FIG. 3 against the force of the spring K21. When the weight of the notes P is large, the swing arm K9 rotates until it abuts against the stopper K20.

When the ejecting mechanism KK starts operating upon manipulation of a button switch or responsive to a signal indicative of the completion of charging or setting of the notes P, then the ejecting motor KPM is actuated so that the front ejecting roller K5 rotates in a direction indicated by an arrow in FIG. 3. The rear ejecting roller K6 is accordingly rotated by means of the belt K16 at the same speed and in the same direction.

By virtue of the rotation of the ejecting rollers K5 and K6, a single note at the bottom of the stack is moved out by friction with the surface of the rear ejecting roller K6. The note at the bottom slides off the next note, and is separated from the next note by means of the gate K25 formed of the adjacent surfaces of the ejecting roller K5 and the gate roller K24.

As the ejection of notes P progresses, the weight of the accumulated notes P gradually reduces. Therefore, the swing arm K9 under the biasing of the spring K21 is gradually pivoted upward, i.e., counterclockwise and when the detection portion K22 of the swing arm K9 goes out of alignment with the sensor K23, the pusher motor KM2 is actuated responsive to a signal from the sensor K23 and makes the pusher K2 move down by means of the pulley K30 and the wire rope K32.

With the pusher K2 moving down, the pusher plate K24 is brought into contact with the upper surface of the uppermost note, and moving the pusher body K2 further down makes the notes P to be pressed thereby to push down the rear ejecting roller K6. Thus, the swing arm K9 pivots downward until the detecting portion K22 aligns with the sensor K23, when the pusher motor KM2 stops in response to a signal from the sensor K23.

In this manner, the contact pressure of the rear ejecting roller K6 with the lowermost note (the ejecting roller K6 being kept in contact with the notes and performing the ejecting operation) is kept constant by virtue of the upward biasing of the swing arm K9 by the spring K21 and the downward pressing of the pusher body K2, so that ejecting operation can be continued regardless of the change in the amount of the notes P.

FIG. 6 shows a control system.

A central processing device (CPU) controls the entirety of the sorting and counting apparatus in accordance with programs stored in a program memory ROM, and causes a data memory RAM to store various data and flags. The memory areas in the data memory RAM will be described later with reference to FIG. 8.

Figure 7:
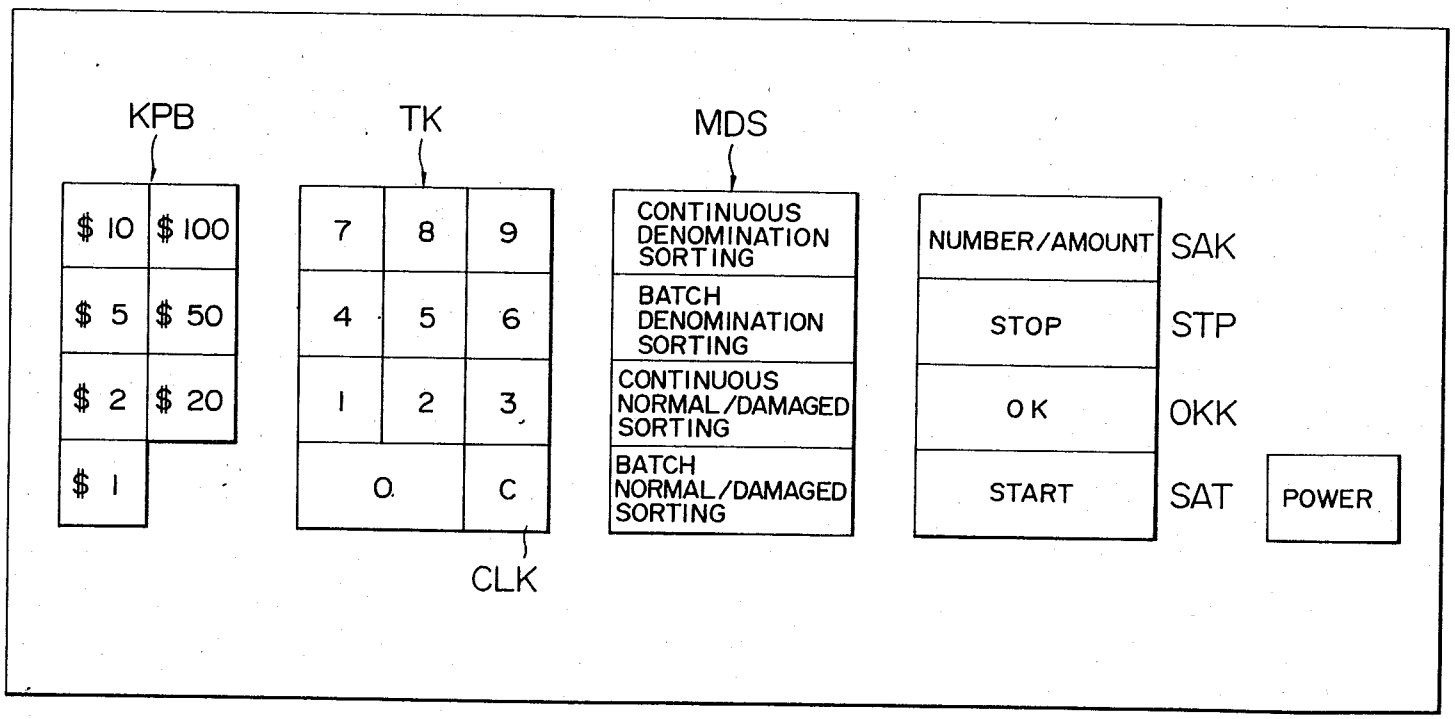
FIG. 7 is a view showing a console section.

A manipulation input section CUNT is for inputting various data, operation instructions, or the like when an operator makes use of the sorting and counting apparatus, and the detailed description thereof will be made later with reference to FIG. 7.

A data display section DISP displays various count data, data relating to an amount of money (monetary value) and the like.

The identifying section 7, the transport drive section HPM, the ejecting drive section KPM, the gate drive section (GPM1 to GPM6), the divider drive section (BPM2 to BPM7), the container drive section (TPM1 to TPM7), the receptacle note sensor KSE, the pre-gate detecting section (GSE1 to GSE6), the post-gate detecting section (HSE1 to HSE7), and the container detecting section (SSE1 to SSE7), have already been described with reference to FIG. 1 and these are connected through a bus line BUS to the central processing unit CPU.

Next, the manipulation input section CUNT will be described in detail, with reference to FIG. 7.

KPB denotes denomination keys which can be operated to designate the denomination, e.g., 1 dollar note to 100 dollar note.

TK denotes ten-keys comprising numerical figure keys from "0" to "9". CLK denotes a clear key operated to clear the data inputted by the ten-keys.

MDS denotes mode switches operated to select one of the various operation modes.

SAK denotes a switch which is operated when the count value indicative of the number of notes counted is desired to be displayed after being converted into the value of an amount of money (monetary value), and which is used where a single display device of the data display section is used both for displaying the number of notes and the amount of money.

STP denotes a stop key. When the stop key STP is depressed, sorting processing stops. The stop key is depressed, for example, when notes are clogged in the transport system.

OKK denotes an approval (OK) key which is used when the separators PH2 and PH3, and the pushers PH4 to PH7 are to be actuated.

SAT represents a start key which is used for manually starting the sorting and counting apparatus. Instead of making the apparatus start upon manipulation of the start key SAT, the apparatus may be such as to be automatically started upon detection by the sensor KSE of notes having been placed on the note receptacle 2.

Referring now to FIG. 8, the memory areas of the data memory RAM will be described.

A buffer memory section BM stores for every one lot, the number of notes (MBM) and the amount of money (KBM) (monetary value) of each of normal (undamaged) and damaged notes for each of the denominations, e.g., 1 dollar note to 100 dollar note, and the total number of notes and the total amount of money, together with the number of rejected notes. The "rejected" note as meant here include notes of extraordinary thickness, linking notes, obliquely moving notes, torn notes and the like, as well as reverse notes.

A main memory section MM stores the accumulated number of notes and the accumulated amount of money (monetary value) for each of the denominations, i.e., 1 dollar note to 100 dollar note, and the totals the accumulated numbers and amounts. Here again the data store include those of normal (undamaged) notes and those of damaged notes. Upon completion of counting of one lot of notes and when the approval key OKK is depressed, the contents of the buffer memory section are added to the contents of the main memory section and the sums are stored in the main memory section in place of the old data. After the addition, the buffer memory section is cleared.

DFG denotes denomination flags. When the denomination is designated by the use of the denomination designation keys KPB, that one of the denomination flags "1" which corresponds to the designated denomination is set at "1", leaving other flags at "0".

MFG denotes mode flags. When the operation mode is selected by the use of the mode switches MDS, that one of the mode keys which corresponds to the designated mode is set at "1".

BCM denotes a batch number memory which stores the batch number input by the ten-keys TK for the batch mode (batch denomination sorting, batch normal/damaged sorting).

IHF denotes coincidence flags. When the number of notes of any kind (denomination, normal/damaged) coincides with the set value during batch operation, the corresponding coincidence flag is set at "1".

Next, the operation of the sorting and counting apparatus will be described with reference to FIGS. 9 to 11.

Figure 9:
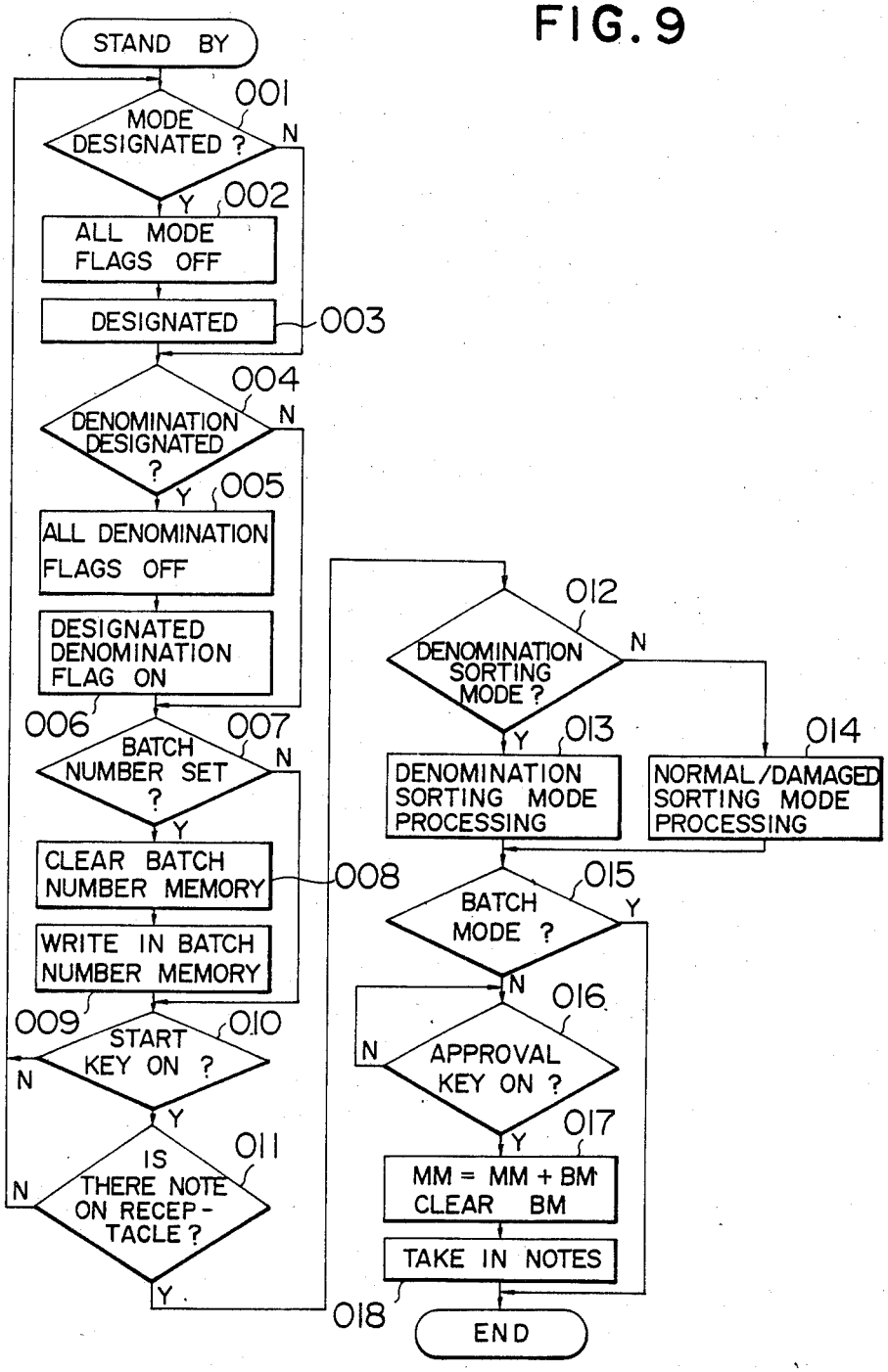
FIGS. 9, 10*a*, 10*b*, 11*a* and 11*b* are flow charts showing the operations.

FIG. 9 shows a series of operations, including the manipulation input by the use of the manipulation input section, sorting and counting processing, and introduction into containers. The outline of the processings are as follows:

The steps 001 to 003 are mode designating operations.

The steps 004 to 006 are denomination designating operations.

The steps 007 to 009 are batch number designating operations.

The steps 010 to 011 are start command processings.

Figure 10A:
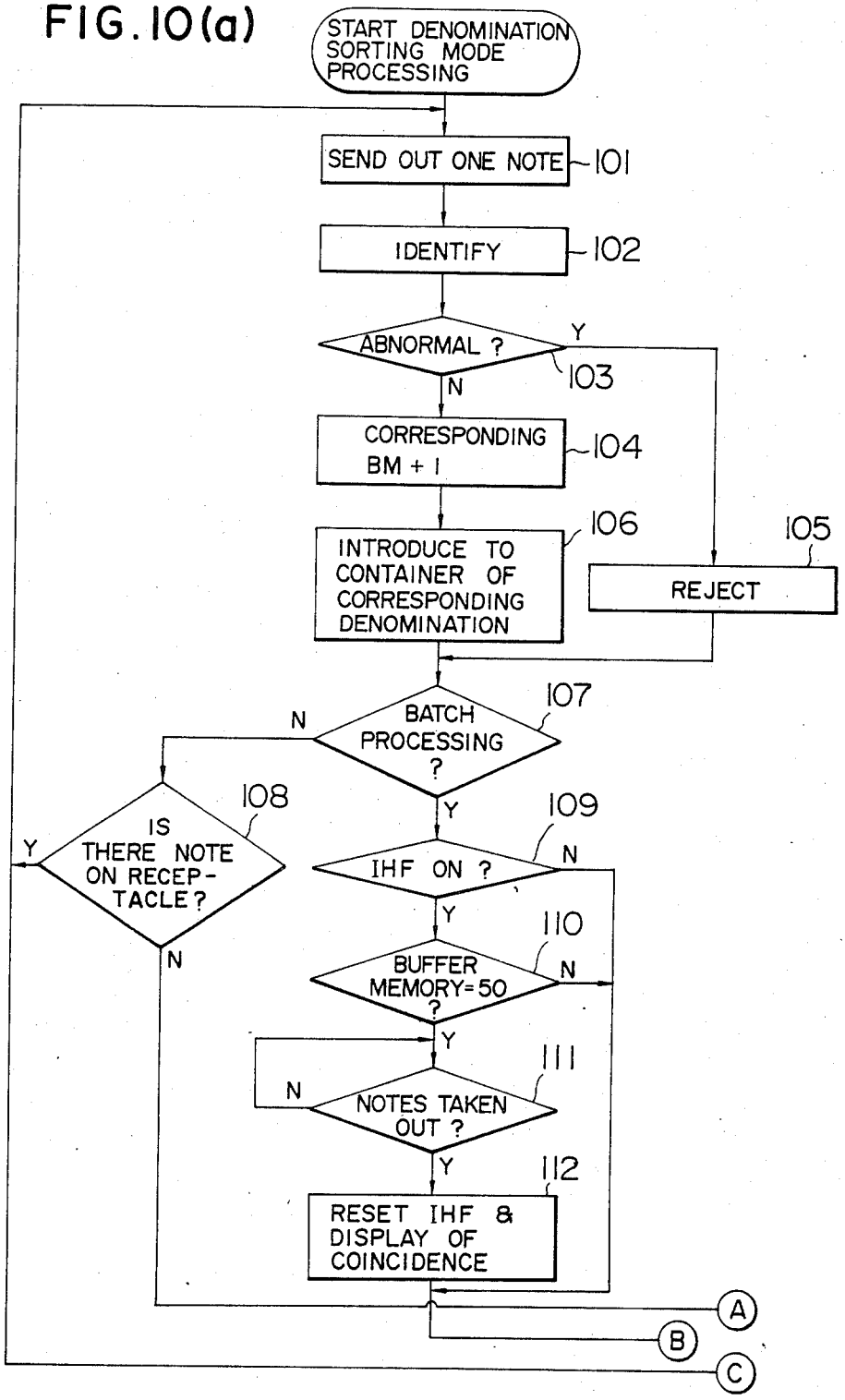
Figure 10B:
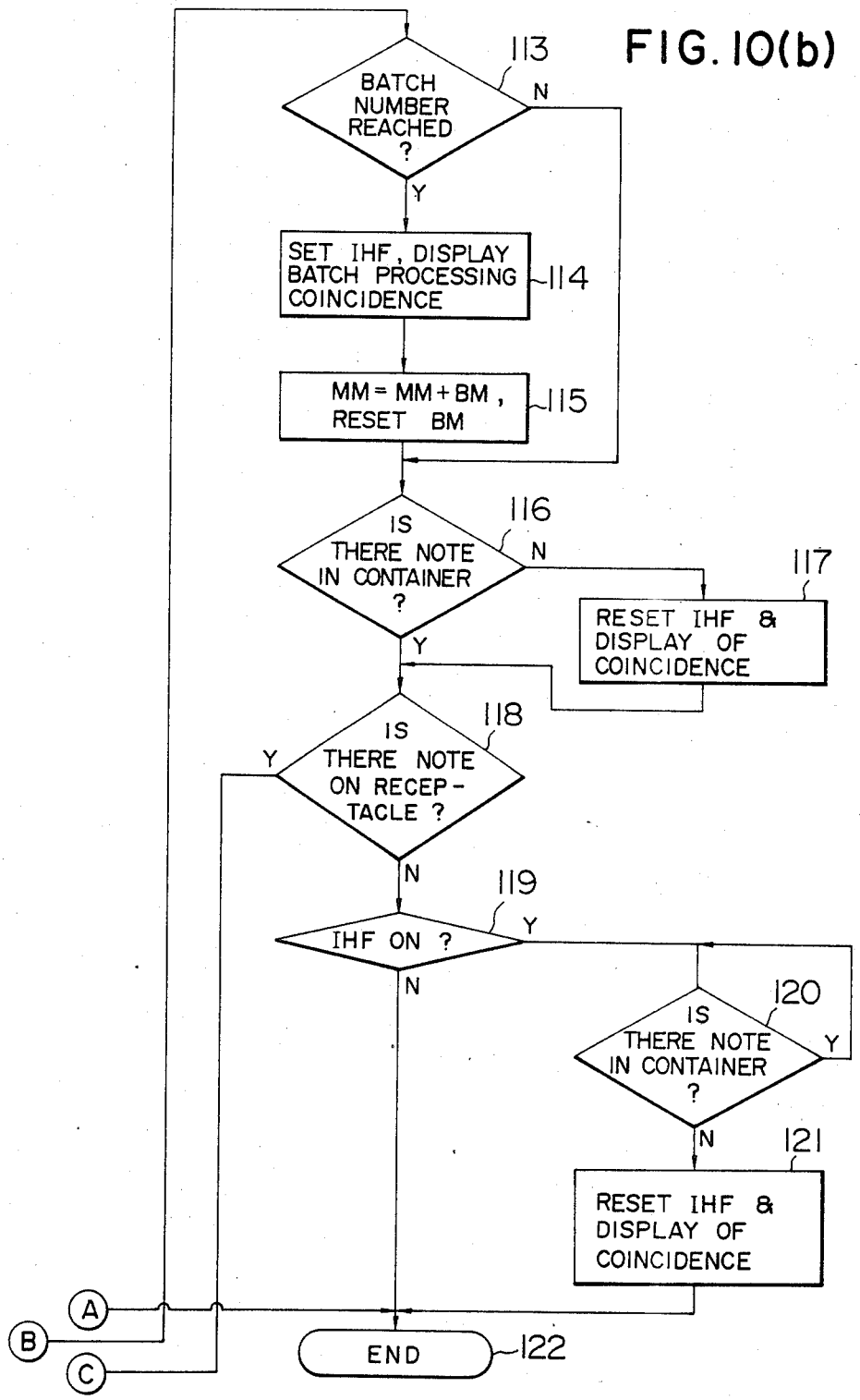
Figure 11A:
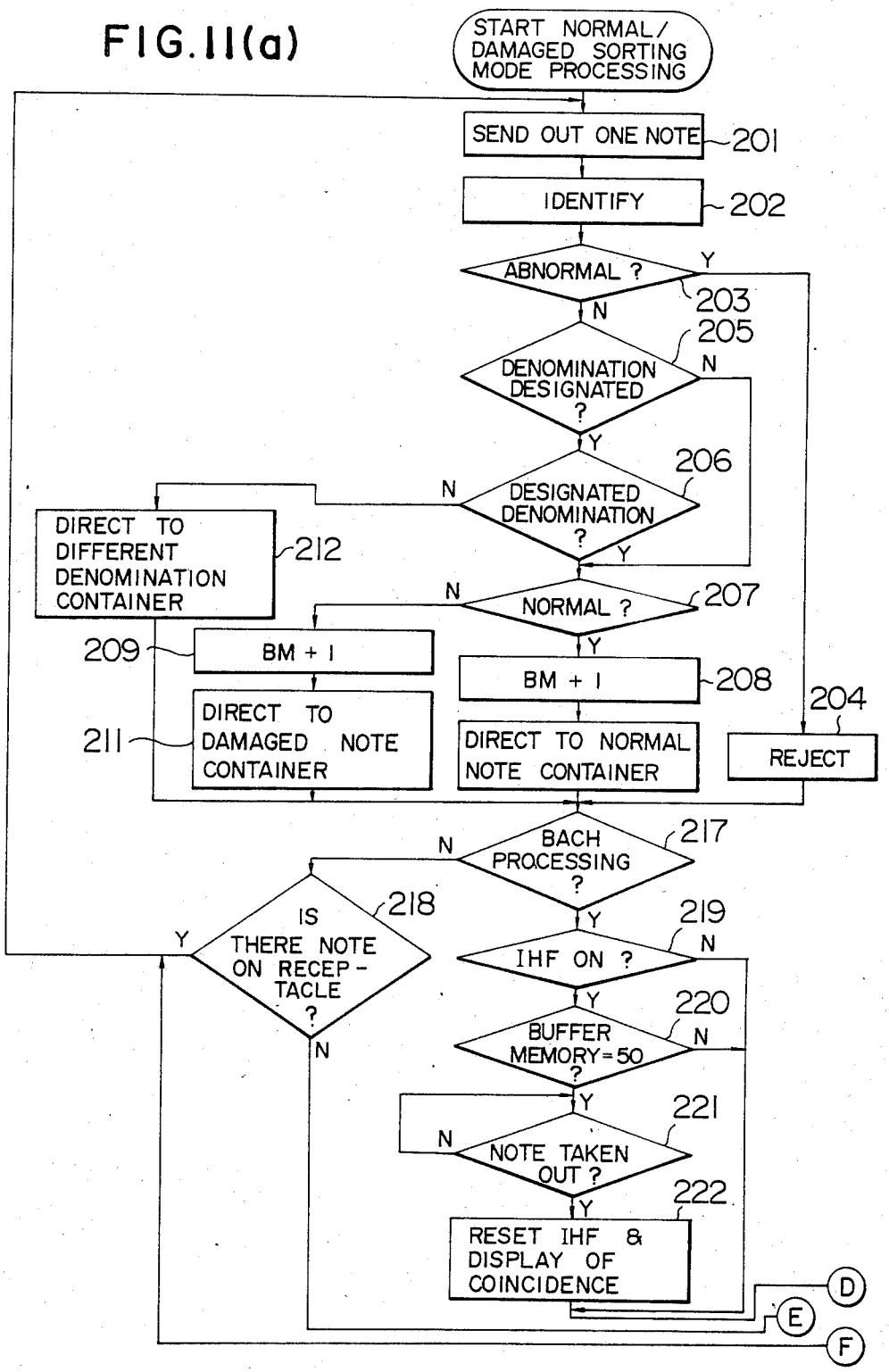
Figure 11B:
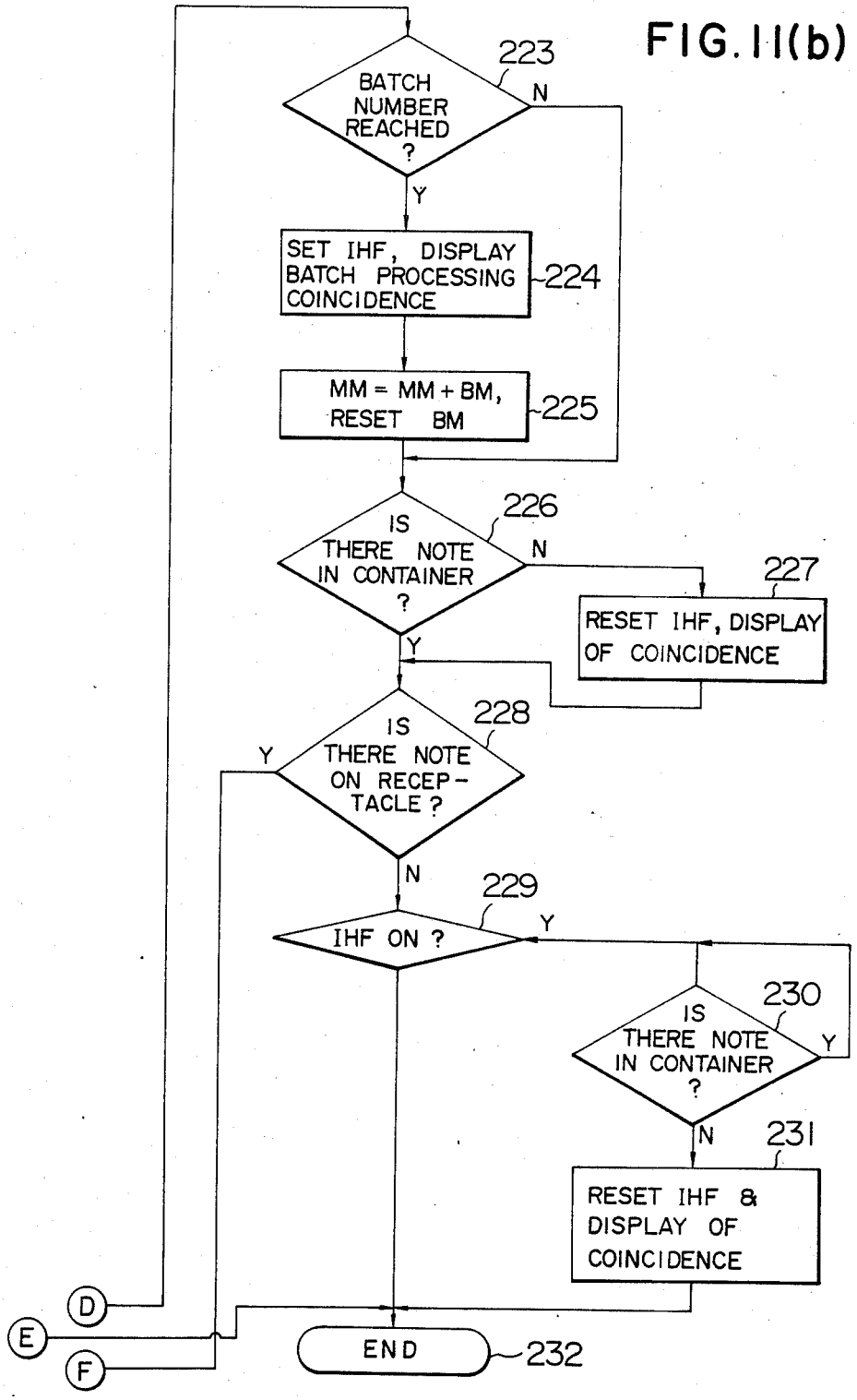

The steps 012 to 014 are sorting and counting operations for each mode (shown in detail in FIGS. 10 and 11).

The steps 015 to 018 are addition and introduction into containers in a sorting mode.

Various steps of the operation will now be described one by one.

First it is judged whether the manipulation input has been made to select (or change selection) one of the operation modes of the continuous denomination sorting, the batch denomination sorting, the continuous normal/damaged sorting, the batch normal/damaged sorting (001). If, for example, the "continuous denomination sorting" is designated, the flag of the designated "continuous denomination sorting" is set at "1" (003) after all of the mode flags MFG of the RAM have been set at "0" (002). Thus, not more than one mode flag is set at "1" simultaneously. When there has been no manipulation input, that is, when the previously designated mode is to be continued, then the procedure "jumps" from the step 001 to the step 004.

Next, it is judged whether the manipulation input has been made to select (or change selection) one of the denominations (004). If it has been made, all the denomination flags DFG are set at "0" (005), and then the designated denomination flag, for example, that of 10 dollar note, is set at "1". The denomination designation processing is valid only when the continuous normal/-damaged sorting mode or the batch normal/damaged selection mode is designated. If the manipulation input to select the denomination has not been made, then the step 004 is directly followed by a step 007.

When a dividing process (batch processing) for separating a predetermined number of notes is desired, such predetermined number is input with the use of the ten-keys TK. Whether this has been done is judged (007), and if it has, the content of the batch number memory BCM is cleared (008), and thereafter, the input numerical value (the batch number) is stored (009). If the batch number is not input at the step 007, then a step 010 immediately follows. The input of the batch number is valid only when the batch denomination sorting mode or the batch normal/damaged sorting mode is designated.

Next, judgement is made as to whether or not the start key SAT has been depressed. If the key has not been depressed, then the procedure returns to the step (001), and the steps (001), (004) and (007) are repeated. By having such a procedure followed, it is possible that the data already input be corrected or by depressing the key or keys corresponding to the data to be corrected, before depressing the start key SAT.

When the start key SAT is depressed (010), judgement is made as to whether or not notes are placed on the note receptacle 2 (011). That is, whether the note sensor KSE provided for the note receptacle 2 is detecting a note or notes is judged. If there is no note, the following steps are not carried out regardless of the depression of the start key. If there is a note or notes, the ejecting drive section KPM and the transport drive section MPM are actuated. That is, first, mode flags MFG are searched to identify the selected mode (012), and either a denomination sorting mode processing (013) or a normal/damaged sorting mode processing (014) is executed depending upon the designated mode. Here, the denomination sorting mode processing is executed when the continuous denomination sorting mode or the batch denomination sorting mode is designated, and the normal/damaged sorting mode processing is executed when the continuous normal/damaged sorting mode or the batch normal/damaged sorting mode is designated. Upon completion of the denomination sorting mode processing or the normal/damaged sorting mode processing, judgement is made as to whether one of the batch modes (batch denomination sorting or batch normal/damaged sorting) is designated by referring to the mode flags (015), and if a batch mode is designated, the operation ends. If no batch mode is designated, the procedure goes to step 016, and when the approval key OKK is depressed (016), the count data in the buffer memory section BM is added to the content of the main memory section MM, and thereafter the buffer memory section is cleared (017). The content of the main memory section MM is displayed on the data display section.

After that, the notes are taken into the bottoms or the lower parts of the containers S2–S7 by driving the separators PH2 and PH3, and the pushers PH4 to PH7 (018). When the continuous denomination sorting mode or the continuous normal/damaged sorting mode is designated the separators PH2 and PH3 need not be driven.

Next, the denomination sorting mode processing (continuous or batch) of the step 013 shown in FIG. 9 will be described in detail with reference to FIGS. 10(*a*) and 10(*b*).

The ejecting mechanism KK sends out, from the bottom of the piled-up notes on the note receptacle 2, one note and transfers it to the transport belt 6 (101). The note transferred is then identified (102) at the identifying section 7. As the continuous denomination sorting mode is designated, the identification is made as to "true/counterfeit", "denomination", "obverse/-reverse", "thickness", "link", "oblique motion", "tear", and the like (identification as to "normal/damaged" is not included). When the "reverse", "extraordinary thickness", "link", "oblique motion", or "tear" is detected (103), the note is judged to be an abnormal note and is introduced (105) into the first container S1 (rejection pocket).

If the note is normal, "1" is added to the content of the buffer memory section at an area corresponding to the identified denomination (since the normal/damaged identification is not made, either one of the memory areas, for example, the normal note memory area, is used). Then, the normal note is introduced (106) into the container assigned to the particular denomination. For example, the containers are assigned to the respective denominations as shown in FIG. 12 at row A. If the note is one dollar note, the motor GPM4 of the gate drive section is driven when the sensor GSE4 detects the leading edge of the one dollar note. The gate plate GB4 is thereby rotated as indicated by a broken line so that the one dollar note is deflected and directed to the transport system n and the one dollar note is made to assume a horizontal position by means of the impeller HA4 and is made to fall.

Next, judgement is made as to whether the batch mode is designated (107). If the batch mode is not designated, then the above operations are repeated until all the notes on the note receptacle 2 have been sent out (108).

When there is no longer any note on the note receptacle 2 (108), the sorting and counting processing is terminated (122), and the transport system, gate rollers, and the ejecting rollers are stopped.

When, at the step 107, the batch mode is found to be designated, judgement is made (109) as to whether the coincidence flag is set at "1". The coincidence flag IHF is set at "1" on condition that the count number has come into coincidence in the sorting and counting processing and that the sensor (one of SSE1 to SSE7) of the container detecting section is detecting the notes in the container assigned to the denomination on which the coincidence has occurred.

If none of the coincidence flags IHF is set at "1", then a step 113 follows. At the step 113 judgement is made as to whether the contents of the batch number memory BCM and the number data of the buffer memory section at an area for the identified denomination coincide with each other. No similar judgement need to be done in connection with other denominations (other than that identified). If they do not coincide, then a step 116 follows, wherein judgement is made as to whether or not the sensor (one of the sensors SSE1 to SSE7) for the container of the identified denomination is detecting the note, i.e., whether any note is retained in that container. If it is found there is, a step 118 follows. On the other hand, if the sensor is detecting no note, it is considered that the notes have been taken out of the note container, and the corresponding coincidence flag IHF is reset (set at "0") and the display (indication) of the coincidence is turned off (117). A step 118 then follows. Although, not shown in the flow chart, when the first note is identified, the step 118 may directly be proceeded to since at that time the sensor (one of the sensors SSE1 to SSE7) provided for the container assigned to the identified denomination is not detecting a note.

At the step 118, if there is a note on the note receptacle 2 (this is detected by the receptacle note sensor KSE), the procedures returns to the step 101, so that ejection of notes is continued.

When the notes run out, then judgement is made as to whether the coincidence flag IHF is set at "1" (119). If it is set, the procedure goes to a step (120) where it is waited that notes are taken out of the container, that is, the sensors SSE1 to SSE7 detect the absence of notes. Then, the coincidence flag IHF is reset and the coincidence display is turned off (121) and the denomination sorting mode processing ends (122).

If, at the step 109, the coincidence flag IHF (the flag corresponding to the denomination identified by the identifying section 7) is formed to be set at "1", judgement is made as to whether the number of such a denomination stored in the buffer memory section is a predetermined number, for example, 50 (110). (This judgement is made in order to prevent clogging of the notes: when the content of the buffer memory section is 50, the divider is holding 50 notes between the divider and the corresponding impeller. If the supply of notes is continued, clogging of notes may occur between the impeller and the divider.) If the number in the buffer memory section is already 50, it is waited that the notes which were processed previously and retained on the supporting plates are taken out (111). Ejection operation (101) of further notes is suspended. The notes of the other denominations being conveyed are sent into the respective containers. When the notes are taken out (111), the corresponding coincidence flag IHF is reset and the coincidence display is also reset (112).

If at the step 113, the batch number is reached, the coincidence flag IHF of the corresponding denomination is set at "1" (114). The following notes are separated by rotating counterclockwise the divider after the note which has caused the batch number to be reached, i.e., the 50th note is inserted into the impeller, and the coincidence display is made. That is, the corresponding coincidence display lamp, not shown, is illuminated (114). Then, with respect to the notes with which the coincidence has occurred, the data of the buffer memory section and the data of the main memory section are added together, and the sum is stored in the main memory section, and then, the buffer memory section is reset (115).

Next, the normal/damaged sorting mode processing (continuous or batch) at the step 014 of FIG. 9 will be described with reference to FIGS. 11(*a*) and 11(*b*).

The ejecting mechanism KK ejects a note at the bottom of the stack of notes on the note receptacle 2 and transfers (201) it to the transport belt 6. The note transported is then identified (202) by the identifying section 7. As the normal/damaged sorting mode is designated, the identification is made as to "normal/damaged", "true/counterfeit", "denomination", "obverse/-reverse", "thickness", "link", "oblique motion", "tear", and the like. When "reverse", "extraordinary thickness", "link", "oblique motion", or "tear" is detected (203), the note is judged to be an abnormal note and is transported (205) into the first container S1 (rejection pocket).

If the note is normal, judgement is made as to whether the denomination designation has been made (205) referring to the denomination flags. If the denomination designation has been made, then judgement is made as to whether the note is of the designated denomination (206) referring to the result of the identification made at the step 202. If it is a note of the designated denomination, then judgement is made as to whether it is a normal (undamaged) note or a damaged note (207). Then, "1" is added to the content (number of notes) of either one of the buffer memory areas (208, 209) depending on whether the note is a normal one or a damaged one. The normal or damaged note is led to the normal note container or the damaged note container (210, 211). If the note is of a different denomination note, then it is led to the container allotted to the different denominations (212).

If, at the step 205, the denomination designation is not made, judgement is made as to whether it is a normal one or a damaged one (irrespective of the denomination). Then, "1" is added to the content (number of notes) of either one of the buffer memory areas (208, 209), and the note is led to the corresponding container.

The memory areas used at the steps 208 and 209 are, where the denomination is designated, respectively memory areas for the normal and damaged notes of the designated denomination, while where the denomination is not designated, respectively memory areas for the "total".

The allotment of the containers is as shown in a row B in FIG. 12 (where the denomination is not designated) or a row C (where the denomination is designated).

For example, if the note is obverse and normal (and of the designated denomination where the denomination is designated), upon detection of the leading edge of the note by either one of the sensors GSE4 and GSE5, either one of the motors GPM4 and GPM5 is driven to thereby rotate the gate plate GB4 or GB5 in the direction shown by a broken line, so that the note is transported toward the transport system n or o, and is introduced into the corresponding container. Two containers are allotted for the same kind of note, so that when one of the allotted containers becomes full, the other can be used for receiving the same kind of notes.

Next, judgement is made as to whether it is a batch mode or not (217), and if not, the above operations are repeated until the notes on the note receptacle 2 run out.

Upon the running out of the notes on the note receptacle 2 (218), the sorting and counting processing is terminated, and the transport system, gate rollers, and sending-out rollers stop.

If at the step 217, it is a batch mode, judgement is made as to whether the coincidence flag is set at "1". The setting of "1" of the coincidence flag IHF is effected on condition that the count number in the sorting and counting processing has come into coincidence, and that the sensor (SSE1–SSE7) is detecting the notes in the corresponding container.

If the coincidence flag IHF is not set at "1", then a step 223 follows, where judgement is made as to whether the content of the batch number memory BCM and the number stored at the area of the buffer memory section of the corresponding kind (of the identified note) coincide with each other. As to the notes belonging to the other kinds, the coincidence judgement is not carried out. If the coincidence is not found, then a step 226 follows, where judgement is made as to whether the corresponding sensor (SSE1–SSE7) is detecting the notes retained in the container. If the sensor is detecting a note, a step 228 follows. On the other hand, if the note is not being detected, it is considered that the notes have been taken out from the note container, and the coincidence flag IHF is reset, and the coincidence display is turned off (227). Then, a step 228 follows. Although it is not shown in the flow chart, when the first note is identified, the step 228 may directly be proceeded to since at that time the sensor (SSE1–SSE7) corresponding to the identified kind is not detecting a note.

If, at the step 228, there is a note on the note receptacle 2 (this is detected by the receptacle note sensor KSE), the operation goes back to the step 201 to continue to send out the notes. When the notes run out judgement is made as to whether the coincidence flag IHF is set at "1" (229). If it is set, it is waited that the notes are taken out from the container, that is, the sensor (SSE1–SSE7) detects the absence of notes (230), and then the coincidence flag IHF is reset, and the coincidence display is turned off (231) and the normal/-damaged sorting mode processing ends (232).

If, at the step 219, the coincidence flag IHF (the flag corresponding to the identified kind) is set at "1", judgement is made as to whether the number stored in the area of the buffer memory section corresponding to the corresponding kind is a predetermined number, for example, 50. (This judgement is made in order to prevent clogging of the notes: when content of the buffer memory section is 50, the divider is holding 50 notes between the divider and the corresponding impeller. If the supply of notes is continued, clogging of notes may occur between the impeller and the divider.) If the number in the buffer memory section is already 50, it is waited that the notes which were processed previously and retained on the supporting plates are taken out (221). Ejecting operation (201) of further notes is suspended. The notes of the other kinds being conveyed are sent into the respective containers. When the notes are taken out (221), the corresponding flag IHF is reset and the coincidence display is also reset (222).

If at the step 223, the batch number is reached, the coincidence flag IHF of the corresponding kind is set at "1" (224). The following notes are separated by rotating counterclockwise the divider after the note which has caused the batch number to be reached, i.e., the 50th note is to inserted into the impeller, and the coincidence display is made. That is, the corresponding coincidence display lamp, not shown, is illuminated (224). Then, with respect to the notes with which the coincidence has occurred, the data of the buffer memory section and the data of the main memory section are added together, and the sum is stored in the main memory section, and then, the buffer memory section is reset (225).

Although only updating of "the number of the notes" stored in the buffer memory section upon identification has been described, updating of "the amount of money" stored in the buffer memory section is automatically performed accompanying the updating of the number of notes. Further, the total of the number of notes and the total of the amount of money are also updated. Still further, when number of notes as stored in the buffer memory section is added to content of the main memory section, addition of the amount of money is also effected.

It is noted here that the order of the arrangement of the first to seventh containers, the arrangement of the temporary retainers, and the shapes of its supporting plate, bearing plate, pusher, separators, and the like are not limited to those of the above embodiment.

In the denomination sorting made of the above embodiment, the first container S1 allotted for rejected notes, the second container S2 allotted for 100 dollar notes, and the third container allotted for 50 dollar notes or notes of different denominations are of a smaller size, since it is expected that appearance of the notes of these kinds is relatively rare (the 100 and 50 dollar notes have relatively small number of issue and circulation). But these containers may alternatively be of the same size as the fourth to seventh containers.

The issue and circulation of 2 dollar notes are extremely small, so that the 2 dollar notes have been sorted as abnormal notes (although independent counting of 2 dollar notes is made on the data memory). However, if necessary, an additional container for 2 dollar notes may be provided.

As seen from the above description, according to the present invention, only the obverse note of each denomination is collected through a single sorting process. Further, the obverse and normal notes and the obverse and damaged notes are respectively collected through a single sorting process, and also the obverse and normal notes of the designated denomination and the obverse and damaged notes of the designated denomination are respectively collected through a single sorting process. Thus, the time for completing the sorting for obtaining a collection of desired kind of notes is shortened, and the chance of any accident such as note clogging, transport miss, to occur is reduced. Therefore, efficiency of sorting and counting is improved.

What is claimed is:

1. A note sorting and counting apparatus comprising:

ejecting means for ejecting notes one by one from a stack of notes;

identifying means for identifying the notes ejected by said ejecting means, the identification in connection with each note being at least as to whether the note is obverse or reverse and as to the denomination of the note;

sorting means for sorting the notes successively ejected by said ejecting means into groups comprising obverse notes of the respective denominations and a group comprising reverse notes, in accordance with the result of the identification made by said identifying means;

a plurality of containers, one container alloted to each of the respective groups;

said sorting means directing each note to the container alloted to the group to which the particular note belongs;

some individual containers of said plurality of containers including a retaining section for receiving and retaining the notes directed to the particular individual container and allowing the notes retained therein to be taken out, a storage section, and transfer means for transferring notes from the retaining section to the storage section, each of said individual containers being provided with a sensor for detecting notes in the retaining section;

mode switch means for selecting the operation mode of the apparatus from a plurality of operation modes, one of the operation modes being a batch processing mode in which notes are sorted and counted into batches each consisting of a predetermined number of notes;

an approval key for commanding transfer of notes from the retaining sections to the respective storage sections of said individual containers; and control means for controlling operation of said ejecting means when the batch processing mode is selected in such a manner that when a second predetermined number of notes is sensed by one of said sensors said ejecting means is stopped, and when said one of said sensors senses that notes in the associated individual container retaining section have been taken out, said ejecting means is restarted, and for causing operation of said transfer means to transfer notes from the retaining sections into the storage sections in response to the actuation if said approval key when the batch processing mode is not selected.

2. An apparatus according to claim 1, further comprising:

note receptacle means provided to allow a stack of notes to be manually thereon from outside of the apparatus;

said ejecting means ejecting notes from the stack of notes on said receptacle means.

3. An apparatus according to claim 1, further comprising:

transport means transporting, along a transport path, the notes ejected by said ejecting means, said sorting means comprising a plurality of gate means respectively associated with the containers, each of the gate means being provided to deflect a note from the transport path to the associated container when that note is found, as a result of said identification, to be of the group to which the container is allotted.

4. An apparatus according to claim 3, wherein:

said identifying section identifies the notes as they are transported along the transport path and before they pass that part of the transport path at which said gate means are provided.

5. A note sorting and counting apparatus comprising:

ejecting means for ejecting notes one by one from a stack of notes;

identifying means for identifying the notes ejected by said ejecting means, the identification in connection with each note being at least as to whether the note is obverse or reverse and as to whether the note is normal or damaged;

sorting means for sorting the notes successively ejected by said ejecting means into a group comprising obverse and normal notes and a group comprising obverse and damaged notes, in accordance with the result of the identification made by said identifying means;

a plurality of containers, one container allotted to each of the respective groups;

said sorting means directing each note to the container allotted to the group to which the particular note belongs;

some individual containers of said plurality of; containers including a retaining section for receiving and retaining the notes directed to the particular individual container and allowing the notes retained therein to be taken out, a storage section, and transfer means for transferring notes from the retaining section to the storage section, each of said individual containers being provided with a sensor for detecting notes in the retaining section;

mode switch means for selecting the operation mode of the apparatus from a plurality of operation modes, one of the operation modes being a batch processing mode in which notes sorted and counted into batches each consisting of a predetermined number of notes;

an approval key for commanding transfer of notes from the retaining sections to the respective storage sections of said individual containers; and control means for controlling operation of said ejecting means such a when the batch processing mode is selected in such a manner that when a second predetermined number of notes is sensed by one of said sensors said ejecting means is stopped, and when said one of said sensors senses that notes in the associated individual container retaining section have been taken out, said ejecting means is re-started, and for causing operation of said transfer means to transfer notes from the retaining sections into the storage in response to the actuation of said approval key when the batch processing mode is not selected.

6. An apparatus according to claim 5, further comprising:

note receptacle means provided to allow a stack of notes to be manually mounted thereon from outside of the apparatus, said ejecting means ejecting notes from the stack of notes on said receptacle means.

7. An apparatus according to claim 5, further comprising:

transport means transporting, along a transport path, the notes ejected by said ejecting means, said sorting means comprising a plurality of gate means respectively associated with the containers, each of the gate means being provided to deflect a note from the transport path to the associated container when that note is found, as a result of said identification, to be of the group to which the container is allotted.

8. An apparatus according to claim 7, wherein:

said identifying section identifies the notes as they are transported along the transport path and before they pass that part of the transport path at which said gate means are provided.

9. A note sorting and counting apparatus comprising:

ejecting means for ejecting notes one by one from a stack of notes;

identifying means for identifying the notes ejected by said ejecting means, the identification on connection with each note being at least as to whether the note is obverse or reverse, as to whether the note is normal or damaged, and as to the denomination of the note;

denomination designating means for designating a denomination to be identified;

sorting means for sorting the notes successively ejected by said ejecting means into a group comprising obverse and normal notes of the designated denomination, a group comprising obverse and damaged notes of the designated denomination and a group comprising notes of denominations which are not designated, in accordance with the result of the identification made by said identifying means;

a plurality of containers, one container alloted to each of the respective groups;

said sorting means directing each note to the container alloted to the group to which the particular note belongs;

some individual containers of said plurality of; containers including a retaining section for receiving and retaining the notes directed to the particular individual container and allowing the notes retained therein to be taken out, a storage section, and transfer means for transferring notes from the retaining section to the storage section, each of said individual containers being provided with a sensor for detecting notes in the retaining section;

mode switch means for selecting the operation mode of the apparatus from a plurality of operation modes, one of the operation modes being a batch processing mode in which notes are sorted and counted into batches each consisting of a predetermined number of notes;

an approval key for commanding transfer of notes from the retaining sections to the respective storage sections of said individual containers; and control means for controlling operation of said ejecting means when the batch processing mode is selected in such a manner that when a second predetermined number of notes is sensed by one of said sensors said ejecting means is stopped, and when said one of said sensors senses that notes in the associated individual container retaining section have been taken out, said ejecting means is restarted, and for causing operation of said transfer means to transfer notes from the retaining sections into the storage sections in response to the actuation of said approval key when the batch processing mode is not selected.

10. An apparatus according to claim 9, further comprising:

note receptacle means provided to allow a stack of notes to be manually mounted thereon from outside of the apparatus, said ejecting means ejecting notes from the stack of notes on said receptacle means.

11. An apparatus according to claim 9, further comprising:

transport means transporting, along a transport path, the notes ejected by said ejecting means, said sorting means comprising a plurality of gate means respectively associated with the containers, each of the gate means being provided to deflect a note from the transport path to the associated container when that note is found, as a result of said identification, to be of the group to which the container is allotted.

12. An apparatus according to claim 11, wherein.

said identifying section identifies the notes as they are transported along the transport path and before they pass that part of the transport path at which said gate means are provided.

* * * * *